US005163783A

United States Patent [19]

Fahrmeier et al.

[11] Patent Number: 5,163,783

[45] Date of Patent: Nov. 17, 1992

[54] APPARATUS FOR LEVELING SUBSEA STRUCTURES

[75] Inventors: Charles F. Fahrmeier; John W. Brandon, both of Kingwood; Larry R. Kovar, Humble; Richard B. Lee, Spring, all of Tex.

[73] Assignee: Marine Contractor Services, Inc., Houston, Tex.

[21] Appl. No.: 791,553

[22] Filed: Nov. 14, 1991

[51] Int. Cl.[5] ..... E02D 27/00

[52] U.S. Cl. ..... 405/195.1; 166/338; 405/224; 405/229

[58] Field of Search ..... 405/229, 195.1-199, 405/224, 227, 230; 166/338-345, 349, 350, 359

[56] References Cited

U.S. PATENT DOCUMENTS

| | | | |
|---|---|---|---|
| 4,212,562 | 7/1980 | Stone et al. | 405/229 X |
| 4,507,069 | 3/1985 | Murray et al. | 405/230 |
| 4,647,257 | 3/1987 | Robishaw | 405/196 X |
| 4,674,920 | 6/1987 | Regan et al. | 405/227 |
| 4,711,603 | 12/1987 | Rippe et al. | 405/230 |
| 4,784,527 | 11/1988 | Hunter et al. | 405/227 X |
| 4,850,743 | 7/1989 | Hopper | 405/196 X |
| 4,911,580 | 3/1990 | Gregory et al. | 405/229 X |

*Primary Examiner*—Dennis L. Taylor
*Attorney, Agent, or Firm*—Kenneth A. Roddy

[57] ABSTRACT

A leveling apparatus is lowered onto a structure, such as a subsea template, having one or more latching receptacles secured thereon and through which a pile has been driven into the ocean floor. The apparatus engages the open end of the pile and releasably latches onto the receptacle. The apparatus has a lift frame at its upper end, a landing ring below the lift frame, a cylinder frame below the landing ring, and a latch frame below the cylinder frame. The lift frame is connected to the latch frame by vertical stabilizer columns secured to the lift frame and connected at their lower ends to latches in the latch frame. The landing ring is slidably mounted on the stabilizer columns and hydraulic lift cylinders secured to the cylinder frame have their rod ends secured to the housing of the latch frame. When the apparatus is suspended by rigging, the landing ring and lift frame are spaced vertically apart and after the landing ring has been engaged on the pile, the rigging goes slack, and the upper lift frame moves vertically downward. The hydraulic cylinders are extended until the latches travel past a load shoulder in the receptacle and are then retracted to positively lock the latches on the receptacle load shoulder. Continued retraction raises the receptacle and connected structure to a desired position so the structure may be secured to the pile. The apparatus is removed by extending the cylinder rods to raise the lift frame and release the latches or by tugging on the lift frame with the rigging.

22 Claims, 9 Drawing Sheets

APPARATUS FOR LEVELING SUBSEA STRUCTURES

BACKGROUND OF THE INVENTION

1. Field of the Invention

This invention relates generally to lifting and leveling subsea structures, and more particularly to an apparatus for latching onto a subsea structure, lifting and leveling the structure, and positively unlatching from the structure without a dedicated signal being sent to the latching mechanism.

2. Brief Description of the Prior Art

In the drilling and production of wells, such as oil and gas wells beneath bodies of water, particularly at offshore locations, it has become accepted practice to install structures on the floor of the body of water known as "templates." These templates serve to provide a base, or support, for the landing and connection of various drilling and production equipment. Templates also provide for the connection thereto of anchors for towers and gravity anchors, or mooring devices. Templates can be anchored to the floor of the body of water by grouting the structure to anchoring piles which have been driven downwardly into the earth below the floor of the body of water. Templates can also be anchored by swaging the downwardly driven piles to the template structure, thereby forming a mechanical attachment of the downwardly driven piles to the template structure.

Often, the ocean floor is not level at the point of installation of the templates. The templates must either be allowed to repose at the angle of the ocean floor or be held in place at a desired plane by known devices. It is desirable to elevate the template to a horizontal plane to facilitate the landing of various drilling and production equipment used in the conduct of drilling, production or workover operations.

Previous methods of bringing a deployed template to a horizontal plane have, so far as is known, utilized either a mud mat-based elevating system or a pile-based leveling system. In a mud mat-based system, the equipment used to elevate the template to a horizontal plane was deployed with, and was an integral part of, the template structure. Inasmuch as the exact extent of required leveling was not known prior to deployment of the template, leveling devices were normally installed integral to the template structure at all corners of the template, even though they later turned out to be unnecessary.

In a pile-based leveling system, the structures used to raise the template to a horizontal plane were separate from the template structure and were deployed as a self-contained structure after the template had been landed on the ocean floor and foundation piling had been driven downwardly through the template structure. Pile-based leveling devices attached themselves to the template structure and reacted against the downwardly driven piles to achieve the leveling forces required to elevate the template to the horizontal plane.

Methods of latching pile-based leveling structures to the template structure have been primarily limited in the past to hydraulically actuated dogs which extended radially to mate with corresponding load bearing surfaces incorporated into the template structure. Other pile-based leveling devices incorporated sets of opposing wedges to grip onto the template structure. These wedges relied on the mass of the template to maintain their grip on the template structure.

A major drawback to the hydraulically actuated dog engagement, as well as the opposing wedge engagement, is that both required an operator or person remotely located on a vessel from the leveling device to perform a sole or dedicated function, that of enabling the connection of the leveling structure to the template. To perform this connection, a command signal was required to control the remote connection operator, requiring an additional control line, when the signal was hydraulic or electrical, between the vessel and the leveling structure. Acoustical control signals were often difficult to detect.

Another major drawback with the previous pile-based leveling structure was that of releasing the leveling structure once the template had been elevated, leveled and locked in position. In the event of a malfunction in the release mechanism system, retrieval of the leveling structure might not be possible. In most pile-based leveling operations, a single leveling device was used. Should the leveling structure not release after leveling of one portion of the template, no further leveling could be accomplished until the latch mechanism was released or unless backup lifting devices were available.

The present invention is distinguished over the prior art in general by a leveling apparatus which is lowered by rigging onto a structure, such as a subsea template, having one or more latching receptacles secured thereon and through which a pile has been driven into the ocean floor. The apparatus engages the open end of the pile and releasably latches onto the receptacle. The apparatus has a lift frame at its upper end, a landing ring below the lift frame, a cylinder frame below the landing ring, and a latch frame below the cylinder frame. The lift frame is connected to the latch frame by vertical stabilizer columns secured to the lift frame and connected at their lower ends to latches in the latch frame. The landing ring is slidably mounted on the stabilizer columns and hydraulic lift cylinders secured to the cylinder frame have their rod ends secured to the housing of the latch frame. When the apparatus is suspended by rigging, the landing ring and lift frame are spaced vertically apart and after the landing ring has been engaged on the pile, the rigging goes slack, and the upper lift frame moves vertically downward. The hydraulic cylinders are extended until the latches travel past a load shoulder in the receptacle and are then retracted to positively lock the latches on the receptacle load shoulder. Continued retraction raises the receptacle and connected structure to a desired position so the structure may be secured to the pile. The apparatus is removed by extending the cylinder rods to raise the lift frame and release the latches or by tugging on the lift frame with the rigging.

SUMMARY OF THE INVENTION

It is therefore an object of the present invention to provide a leveling apparatus for latching onto a subsea structure, lifting and leveling the structure, and positively unlatching from the structure without a dedicated signal being sent to the latching mechanism.

It is another object of this invention to provide a leveling apparatus for lifting and leveling subsea structures such as a template which is supported by the foundation pile and locks with a connection receptacle on the template and reacts against the pile with a lifting force to elevate the template.

Another object of this invention is to provide a leveling apparatus for lifting and leveling subsea structures such as a template which will lift the template on a foundation pile and maintain it in an elevated position while the template is secured to the pile by other conventional anchoring means.

Another object of this invention is to provide a leveling apparatus for lifting and leveling subsea structures which is easily and quickly received and supported on the foundation pile and latched onto a connection receptacle on the structure and removed therefrom without the need of direct intervention by a human operator to affect the latching operation.

A further object of this invention is to provide a leveling apparatus for lifting and leveling subsea structures which is supported by a foundation pile and utilizes a gravity latching system for connection to a receptacle on the structure and utilizes hydraulic pressure to assure firm positive engagement and disengagement of the latches and to react against the pile with a lifting force to elevate the template.

A still further object of this invention is to provide a leveling apparatus for lifting and leveling subsea structures which is simple in construction, economical to manufacture and rugged and reliable in operation.

Other objects of the invention will become apparent from time to time throughout the specification and claims as hereinafter related.

The above noted objects and other objects of the invention are accomplished by the present leveling apparatus which is lowered by rigging onto a structure, such as a subsea template, having one or more latching receptacles secured thereon and through which a pile has been driven into the ocean floor. The apparatus engages the open end of the pile and releasably latches onto the receptacle. The apparatus has a lift frame at its upper end, a landing ring below the lift frame, a cylinder frame below the landing ring, and a latch frame below the cylinder frame. The lift frame is connected to the latch frame by vertical stabilizer columns secured to the lift frame and connected at their lower ends to latches in the latch frame. The landing ring is slidably mounted on the stabilizer columns and hydraulic lift cylinders secured to the cylinder frame have their rod ends secured to the housing of the latch frame. When the apparatus is suspended by rigging, the landing ring and lift frame are spaced vertically apart and after the landing ring has been engaged on the pile, the rigging goes slack, and the upper lift frame moves vertically downward. The hydraulic cylinders are extended until the latches travel past a load shoulder in the receptacle and are then retracted to positively lock the latches on the receptacle load shoulder. Continued retraction raises the receptacle and connected structure to a desired position so the structure may be secured to the pile. The apparatus is removed by extending the cylinder rods to raise the lift frame and release the latches or by tugging on the lift frame with the rigging.

DESCRIPTION OF A PREFERRED EMBODIMENT

Figure 1:
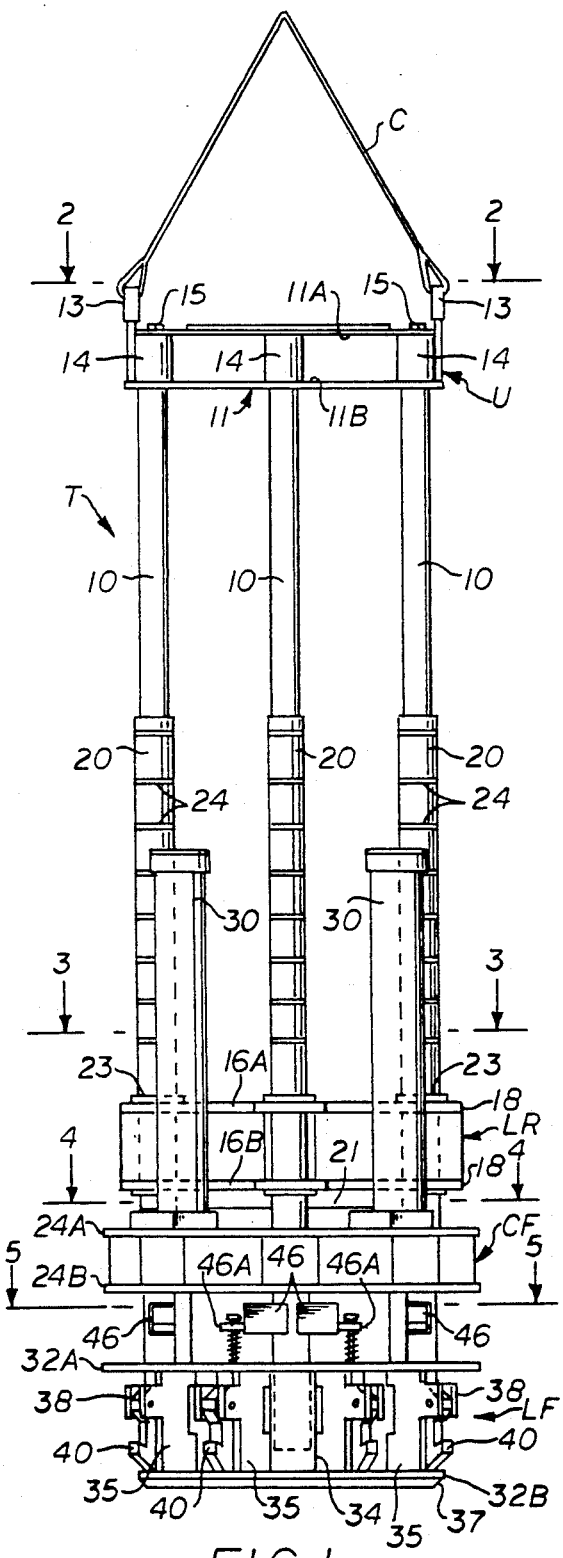
FIG. 1 is an elevation view of a leveling apparatus in accordance with the present invention shown suspended by rigging cables in a lowering or lifting position.

In the following description and drawings, the example of the structure S to be lifted and leveled is described as a subsea template which has been landed on the inclined surface of the ocean floor. The template or structure S is provided with one or more latching receptacles R (only one being illustrated for simplicity). The receptacles R comprise a conventional pipe sleeve which has been modified by the addition of a load shoulder ring at its top end (described hereinafter). A pipe or pile P has been passed through the receptacle R in the structure S and driven downwardly into the ocean floor. The present leveling apparatus or leveling tool T is lowered from a support vessel afloat on the surface of the body of water by conventional cables, or running rigging C, toward the structure S along with hydraulic lines (conventional and not shown) which are attached to the leveling tool T and are simultaneously lowered from the support vessel. The leveling tool T is adapted to engage the open end of the pile P extending upwardly through the receptacle R mounted on the structure S and releasably latch onto the receptacle R. In the drawings, the pile P is shown extending upwardly above the connector receptacle R, however, it should be understood that the top end of the pile may also be below the receptacle R.

Referring now to the drawings by numerals of reference, and particularly to FIGS. 1 through 6, a general description of the major components of the leveling apparatus will be described.

The leveling apparatus or tool T has an upper lift frame U at its upper end which provides the attachment structure for stabilizer columns and an attachment point for equipment, such as hydraulic lines and rigging C used to maneuver the leveling apparatus from the support vessel at the water surface, a landing ring LR below the lift frame which serves as the primary load carrying component of the apparatus, a cylinder frame CF below the landing ring, and a latch frame LF below the cylinder frame by which the leveling apparatus is connected to the receptacle R secured to the structure S to be lifted and leveled.

The upper lift frame U is connected to the latch frame LF by a plurality of vertical circumferentially spaced stabilizer columns 10 secured at their upper ends to the upper lift frame U and slidably connected at their lower ends to latch members 40 pivotally mounted in the latch frame LF. A plurality of circumferentially spaced hydraulic lift cylinders 30 have their cylinder bodies secured to the cylinder frame CF and their rod ends 31 secured to the latch frame LF. The landing ring LR is slidably mounted on the stabilizer columns 10 to allow relative vertical movement therebetween as the assembly is lowered and raised by the rigging C and during leveling operations by the hydraulic lift cylinders 30.

Figure 6:
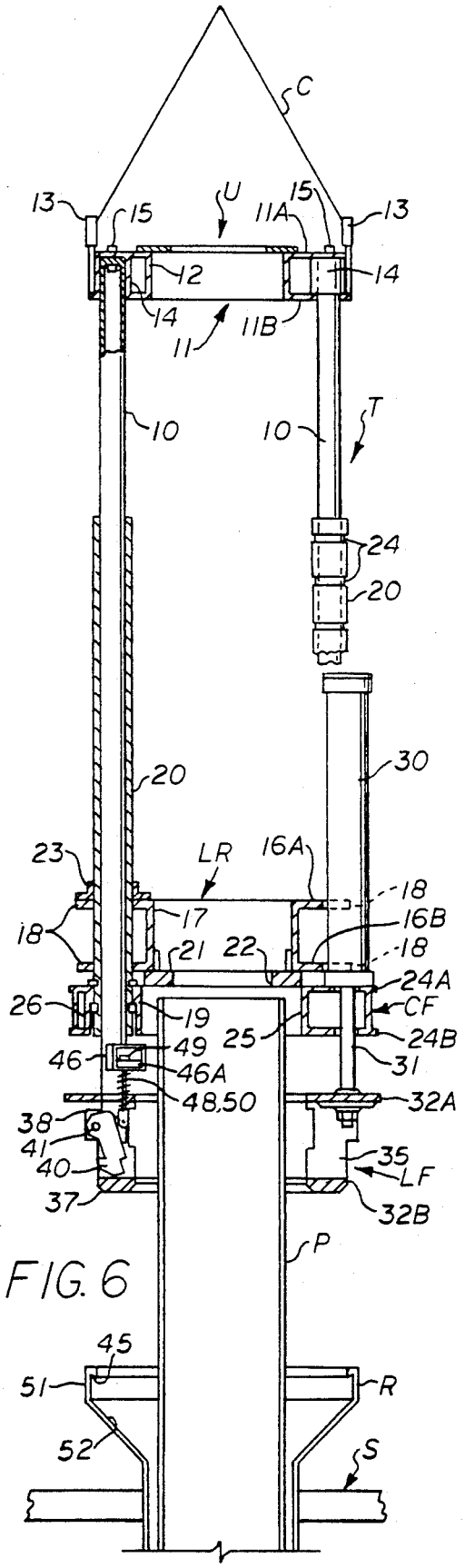
FIG. 6 is a longitudinal cross section of the leveling apparatus taken along line 6—6 of FIG. 2 shown being landed on a foundation pile while being suspended by rigging cables.
Figure 7:
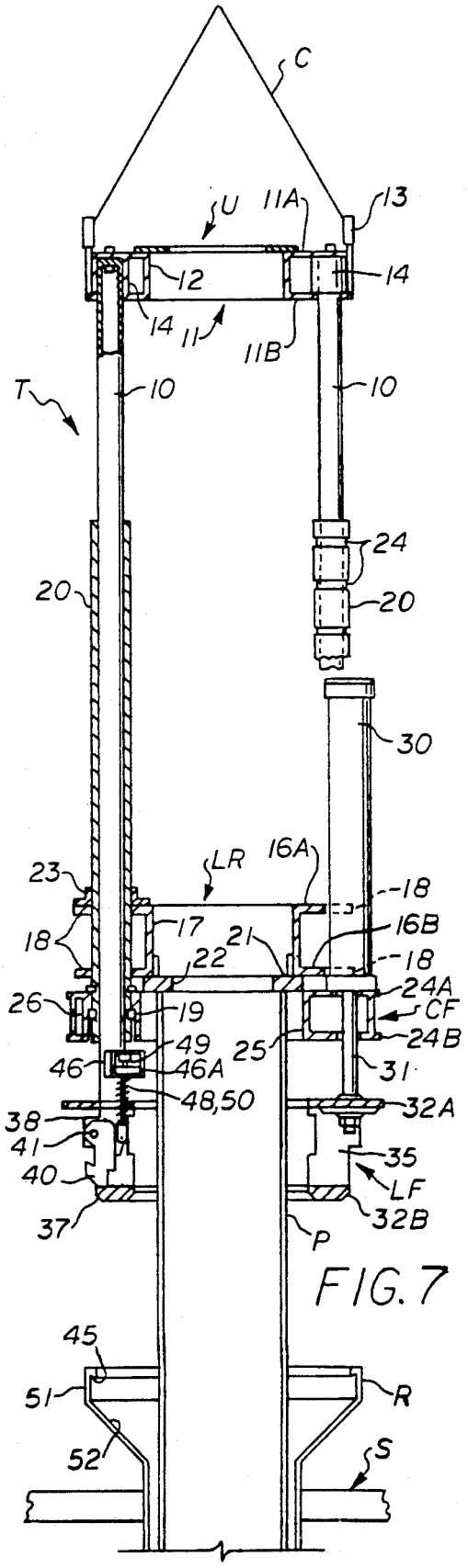
FIG. 7 is a longitudinal cross section of the leveling apparatus with the landing ring supported on the pile and the latch frame suspended above the receptacle.
Figure 8:
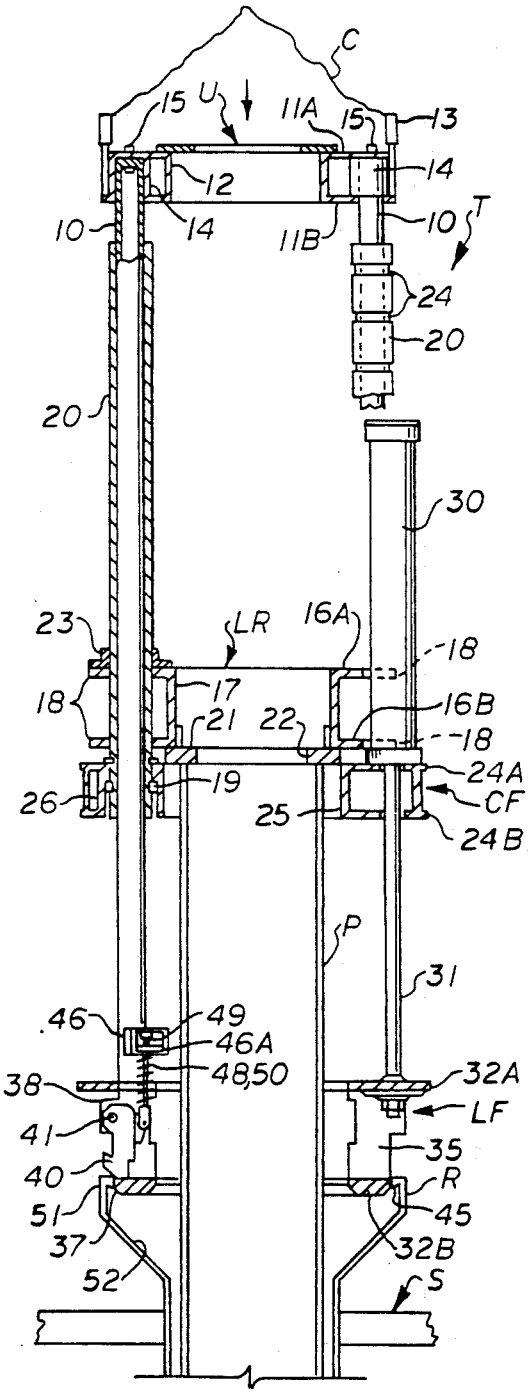
FIG. 8 is a longitudinal cross section of the leveling apparatus with the landing ring supported on the pile and the latch frame being lowered into the receptacle by hydraulic cylinders.

When the leveling apparatus or tool T is suspended by the rigging C, the landing ring LR and the upper lift frame U are spaced a distance vertically apart (FIGS. 1 and 6) and after the tool T has been landed, the rigging C goes slack, and the upper lift frame U moves vertically downward a short distance toward the landing ring LR (FIG. 7). After the tool T has been landed, additional downward vertical movement of the latch frame LF, the stabilizer columns 10, and the upper lift frame U is accomplished by the hydraulic lift cylinders 30. As explained in detail hereinafter, the outward latching movement of the latches 40 is caused by gravity and assisted by springs. Sufficient upward vertical movement of the landing ring LR by the cylinders 30 causes upward vertical movement of the stabilizer columns 10 relative to the latch frame LF to retract the latches and disengage the latches from the receptacle R for removal of the tool T from the structure.

Having generally described the major components of the apparatus, a more detailed description of the leveling apparatus T will be undertaken with reference additionally to FIGS. 7–12.

Figure 2:
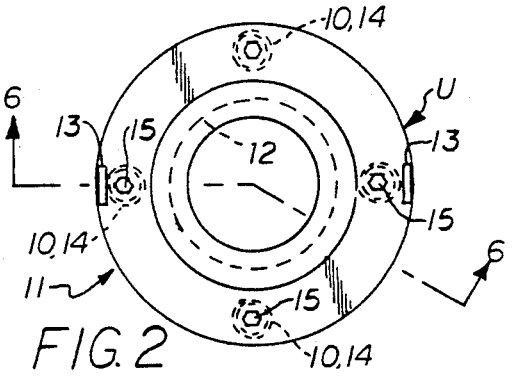
FIG. 2 is a plan view of the leveling apparatus taken along line 2—2 of FIG. 1, showing the lift frame as seen from the top.

Referring additionally to FIGS. 1 and 2, the upper lift frame U is a generally circular frame 11 having an upper plate 11A and a lower plate 11B with a central opening 12 therethrough and integral lift eyes 13 for connecting the leveling apparatus T to the rigging C. A plurality of circumferentially spaced tubular sleeves 14 are secured vertically between the upper and lower plates 11A and 11B near the outer periphery of the lift frame U. The upper ends of a plurality of elongate tubular stabilizer columns 10 are received in the tubular sleeves 14 and each is secured to the upper plate 11A by bolts 15 extending through the top plate 11A and enclosed top end of the columns.

Figure 3:
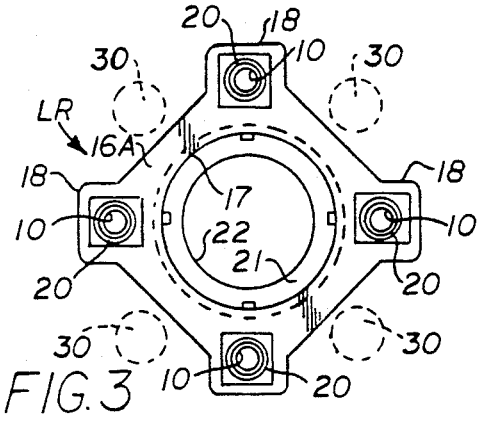
FIG. 3 is a plan view of the leveling apparatus taken along line 3—3 of FIG. 1, showing the landing ring and the arrangement of the stabilizer columns and hydraulic cylinders as seen from the top.

Referring additionally to FIG. 3, the landing ring LR is formed of upper and lower plates 16A and 16B each having a generally square configuration with a central opening 17 therethrough and outwardly extending rectangular portions 18 at each corner. A plurality of elongate tubular guide sleeves 20 are received through the upper and lower plates 16A and 16B. A flat circular stop plate 21 is secured onto the bottom plate 16B of the landing ring LR and has a central opening 22 which is smaller in diameter than the diameter of the pile P. The landing ring LR is adjustably connected to the guide sleeves 20 by a two-piece clamp member 23 which is clamped around the guide sleeve 20 and bolted to the top plate 16A of the landing ring LR. A series of longitudinally spaced circumferential grooves 24 are provided on the outer surface of the guide sleeves 20 to facilitate vertically spacing and clamping of the landing ring LR on the guide sleeves 20. The guide sleeves 20 allow sliding movement of the landing ring LR on the stabilizer columns 10 and the clamps 23 permit the landing ring LR and its stop plate 21 to be positioned vertically relative to the latch frame LF and the pile P, as described below.

Figure 4:
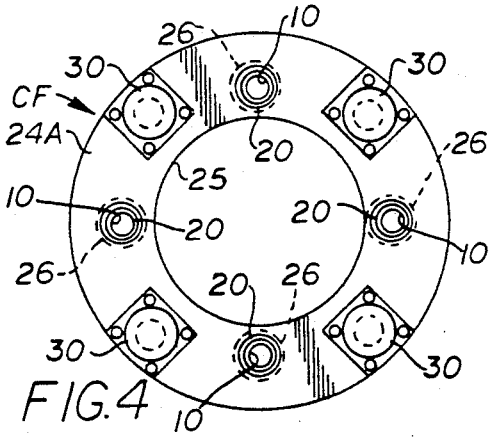
FIG. 4 is a plan view of the leveling apparatus taken along line 4—4 of FIG. 1, showing the cylinder frame and the arrangement of the hydraulic cylinders and stabilizer columns as seen from the top.

Referring additionally to FIGS. 4 and 6, the cylinder frame CF is a generally circular frame having an upper plate 24A and a lower plate 24B with a central opening 25 therethrough and a plurality of circumferentially spaced tubular sleeves 26 secured vertically between the upper and lower plates 24A and 24B. The lower ends of the guide sleeves 20 are received and secured in the tubular sleeves 26 by a split lock ring 19. Holes are provided in the upper and lower plates 24A and 24B at each end of the sleeves 26 to receive the guide sleeves 20. Hydraulic lift cylinders 30 are mounted vertically on the upper plate 24A between adjacent ones of the guide sleeves 20 in circumferentially spaced relation. The upper ends of the hydraulic cylinders 30 extend upwardly from the cylinder frame CF and are positioned between adjacent rectangular portions 18 of the landing ring LR with clearance between the parallel sides of the landing ring plates to allow relative vertical movement therebetween. The piston rod ends 31 of the lift cylinders 30 extend downwardly through circumferentially spaced holes in the upper and lower plates 24A and 24B. The lower ends of the piston rods 31 are connected to the latch frame LF as described below. The lift cylinders 30 are connected through hydraulic lines to a source of fluid pressure on the support vessel at the water surface to operate the cylinders (conventional in the art and not shown).

Figure 5:
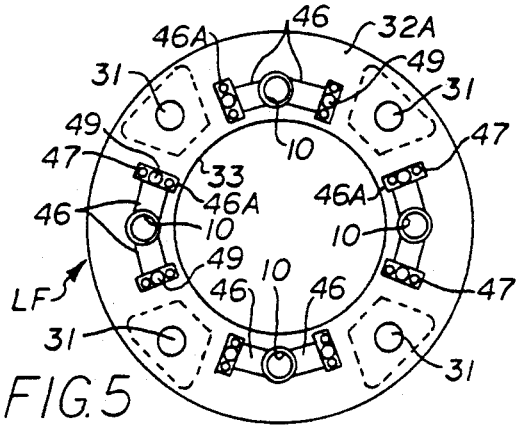
FIG. 5 is a plan view of the leveling apparatus taken along line 5—5 of FIG. 1, showing the latch frame and the arrangement of the hydraulic cylinder rods and stabilizer columns as seen from the top.
Figure 12:
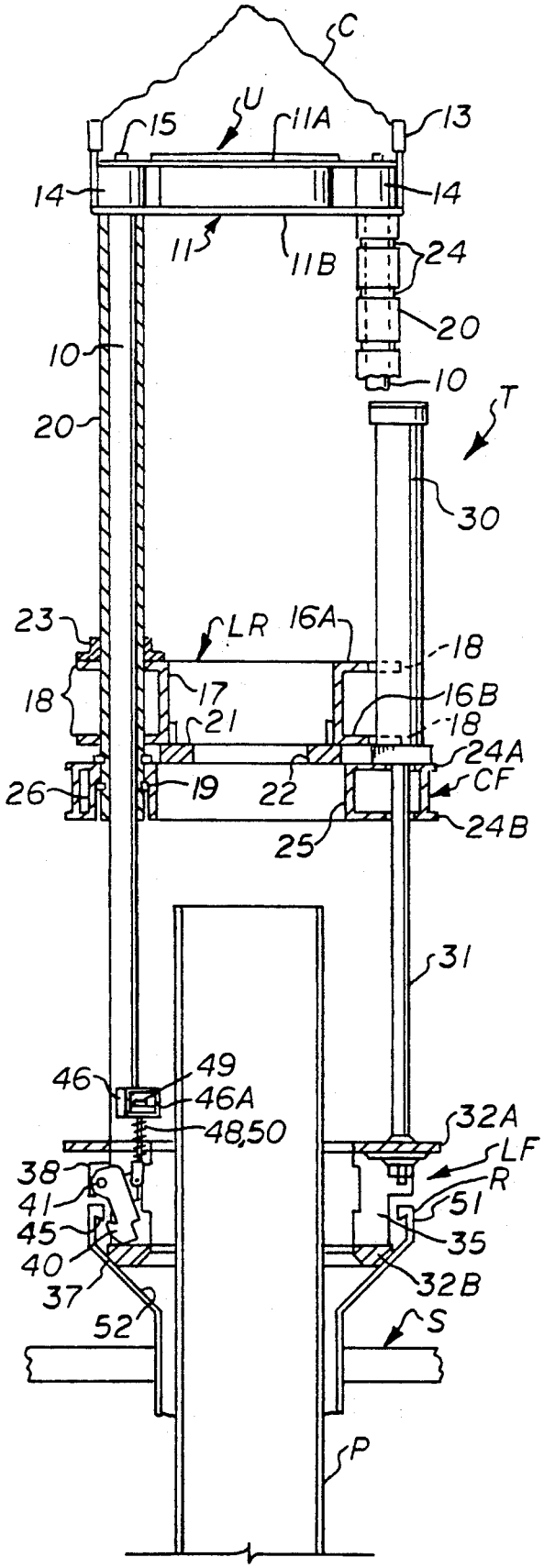
FIG. 12 is a longitudinal cross section of the leveling apparatus with the latch frame supported in the receptacle, the latches retracted, and the landing ring being pushed upwardly off the pile.
Figures 13, 14, 15:
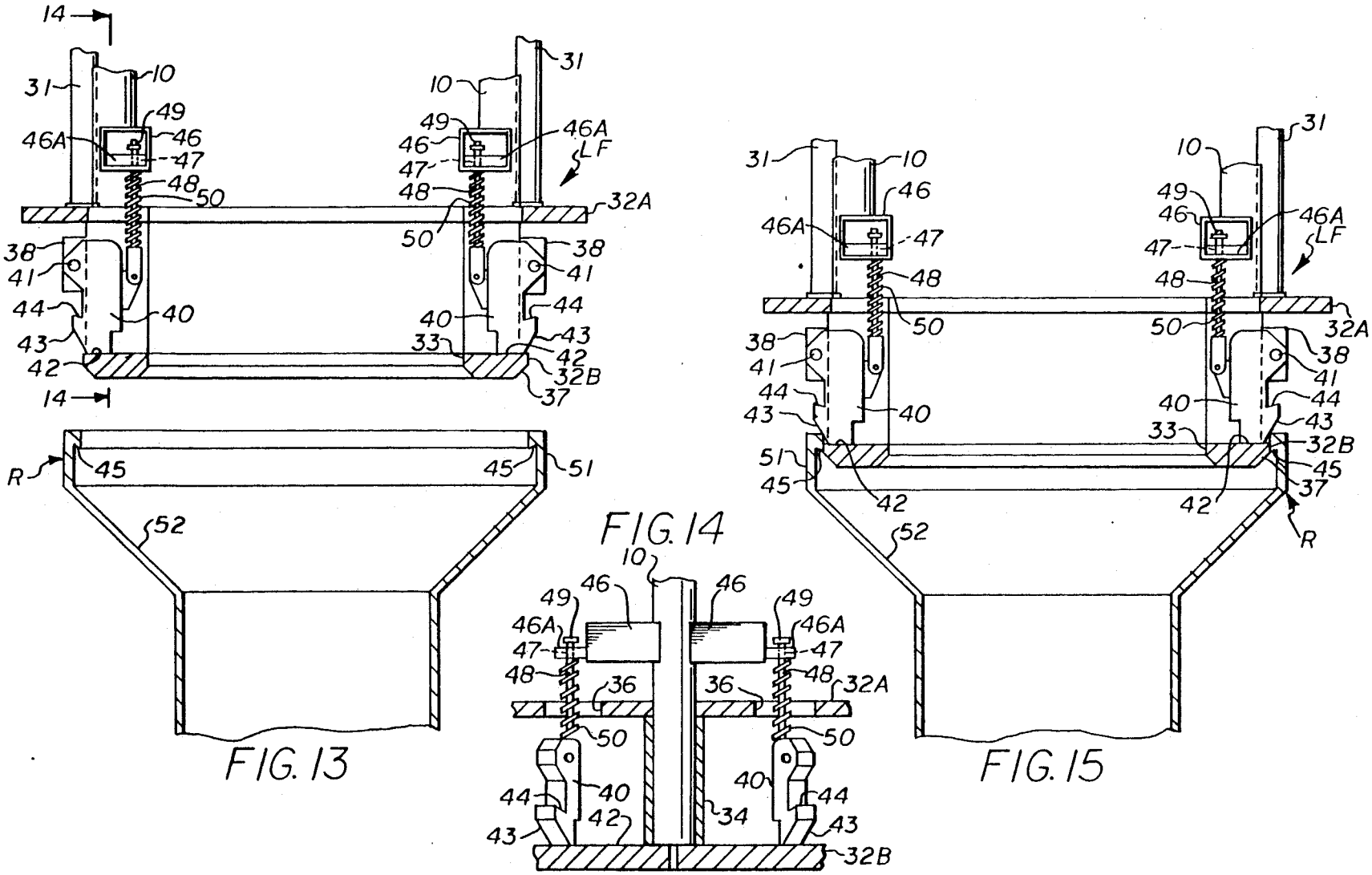
FIG. 13 is a cross section through the latch frame being lowered into a receptacle with the latches shown in the gravity controlled position.
FIG. 14 is a cross section through the latch frame taken along line 14—14 of FIG. 13 showing the bottom end of a stabilizer column in the latch frame and the latch rod and bracket arrangement at the lower end of the column.
FIGS. 15 through 19 are cross sections of the latch frame illustrating the various steps of landing, setting, lifting, releasing, and removing the apparatus from the structure receptacle.

Referring additionally to FIGS. 5, 13 and 14, the latch frame LF is a generally circular frame having an upper plate 32A and a lower plate 32B with a central opening 33 therethrough and a plurality of circumferentially spaced tubular sleeves 34 (seen in FIG. 14) secured vertically between the upper and lower plates 32A and 32B in axial alignment with the tubular sleeves 26 of the cylinder frame CF. The lower ends of the stabilizer columns 10 extend downwardly from the guide sleeves 20 and are slidably received in the tubular sleeves 34. Holes are provided in the upper plate 32A at the top end of each sleeve 34 to receive the lower end of the stabilizer columns 10. The bottom plate 32B serves as a stop surface for the bottom ends of the stabilizer columns 10. As seen in FIGS. 6–12, pairs of radially extending plates 35 are secured vertically between the upper and lower plates 32A and 32B between adjacent ones of the tubular sleeves 34 and connection point of cylinder rod 31 to the latch frame LF. As seen in FIG. 14, radial slots 36 are formed through the upper plate 32A above the space between the pairs of plates 35. Each vertical plate has outwardly extending ears 38 for pivotal attachment of latches (described below). The lower ends of the piston rods 31 extend downwardly from the cylinder frame CF and are bolted to the upper plate 32A of the latch frame LF (FIGS. 6–12). The outer bottom surface of the lower plate 32B is angled 37 to conform to the tapered inner support surface of the receptacle.

As best seen in FIGS. 13–19, a generally J-shaped latch member 40 is received in the space between each pair of vertical plates 35 and is pivotally pinned at its upper outer end between each pair of ears 38 by a pivot pin 41. Each latch 40 is a flat member having flat bottom surface 42 and an outer side edge which extends angularly upward and outward from the bottom surface to serve as a camming surface 43 and has an inwardly and downwardly angled latch shoulder 44 which engages a corresponding angled load shoulder 45 on the interior of the receptacle R. The flat bottom surface 42 of each latch 40 rests on the top surface of the lower plate 32B. The upper inner end of each latch 40 is disposed beneath the slot 36 in the upper plate 32A (FIG. 14).

As best seen in FIG. 14, a pair of square horizontal bracket members 46 having an integral flat outer shelf end 46A are secured to each stabilizer column 10 and extend laterally outwardly to each side thereof and are provided with vertical holes 47 through their flat outer shelf ends 46A. The bracket members 46 are disposed vertically above the upper plate 32A of the latch frame LF and the holes 47 are in axial alignment with the slots 36 in the upper plate 32A. The shank of a small diameter latch rod 48 having a head 49 at its upper end is slidably received through the hole 47 in the bracket shelf end 46A and through the slot 36. The lower end of the latch rod 48 is pivotally pinned to the inner side of the latch 40. A compression spring 50 is received on the shank of the latch rod 48 and has one end engaged on the underside of the bracket shelf end 46A and its other end engaged on the lower end of the latch rod to normally urge the latch rod downwardly. The top surface of the bracket shelf end 46A engages the head 49 of the rod 48 to cause the vertical travel of the rod, hence, serving as a latch travel surface.

Each latch 40 is normally held by gravity in a vertical position with its flat bottom surface 42 resting on the top of the lower plate 32B and the gravity held position is assisted by the spring action of compression spring 50. When the flat bottom end 42 of the latch 40 is engaged on the bottom plate 32B in the gravity controlled position, the latch is prevented from pivoting outwardly but when the angled camming surface 43 of the latch is pressed inwardly or when the latch is raised upwardly by the rod 48 the spring force is overcome and the latch will pivot inwardly to a retracted position.

The latches 40 are shaped such that the forces of gravity will tend to normally position them in a generally vertical position with their angled camming surface 43 and latch shoulder 44 protruding outwardly from the outer periphery of the latch frame LF. Upon sufficient upward vertical movement of the stabilizer columns 10, the upper surface of the horizontal bracket shelf end 46A will engage the head 49 of the rod 48 and lift the rod causing the latch 40 to pivot about the pivot pin 41 and retract the camming surface 43 and load shoulder 44 within the latch frame outer periphery.

As best seen in FIG. 13, the receptacle R comprises a conventional pipe sleeve which has been modified by the addition of a load shoulder ring at its top end. The receptacle R is an open ended generally cylindrical configuration having a side wall which has a cylindrical upper portion 51 and an inwardly and downwardly tapered conical support portion 52 therebelow. The receptacle R is secured to the structure S to be lifted and leveled. The taper of the conical support portion 52 generally corresponds to the angled outer surface 37 of the lower plate 32B of the latch frame LF. The interior surface near the top end of the receptacle R is undercut to form an outwardly and upwardly tapered load shoulder 45. As will be described below, the latch shoulder 44 of the latches 40 are adapted to move outwardly and upwardly into engagement with and lock with the load shoulder 45 in the receptacle R to transfer lifting loads from the leveling tool T to the structure S to be lifted.

In some applications, the leveling tool T may be provided with a stabbing guide to facilitate connection between the lifting tool T and the pile P by means of its insertion into the open upper end of the pile P. Such a stabbing guide would comprise an elongate member secured at its upper end to the upper lift frame U or landing ring LR and its bottom end would taper downward and inwardly a distance below the latch frame LF to form a generally tapered nose portion. The exterior of the stabbing guide would be smaller in diameter than the interior diameter of the pile P to be slidably received therein. It should be understood, however, that the stabbing guide is not necessary in all operations and other guide structures may be used.

ANOTHER EMBODIMENT

Figure 21:
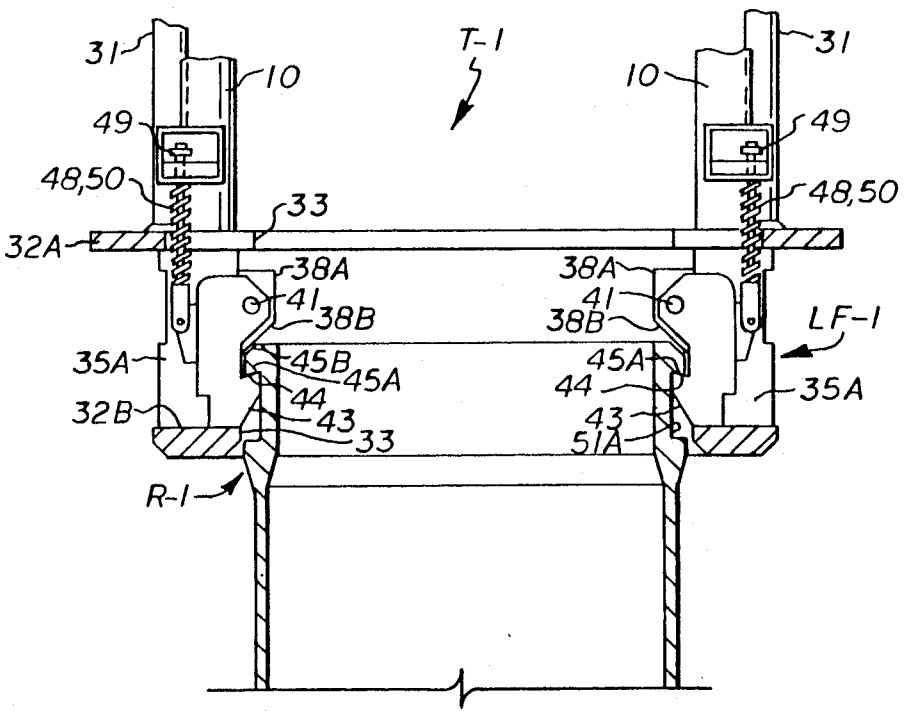
FIG. 21 is a cross section of the embodiment of FIG. 20 shown in a locked position on the receptacle having an external load shoulder.
Figure 20:
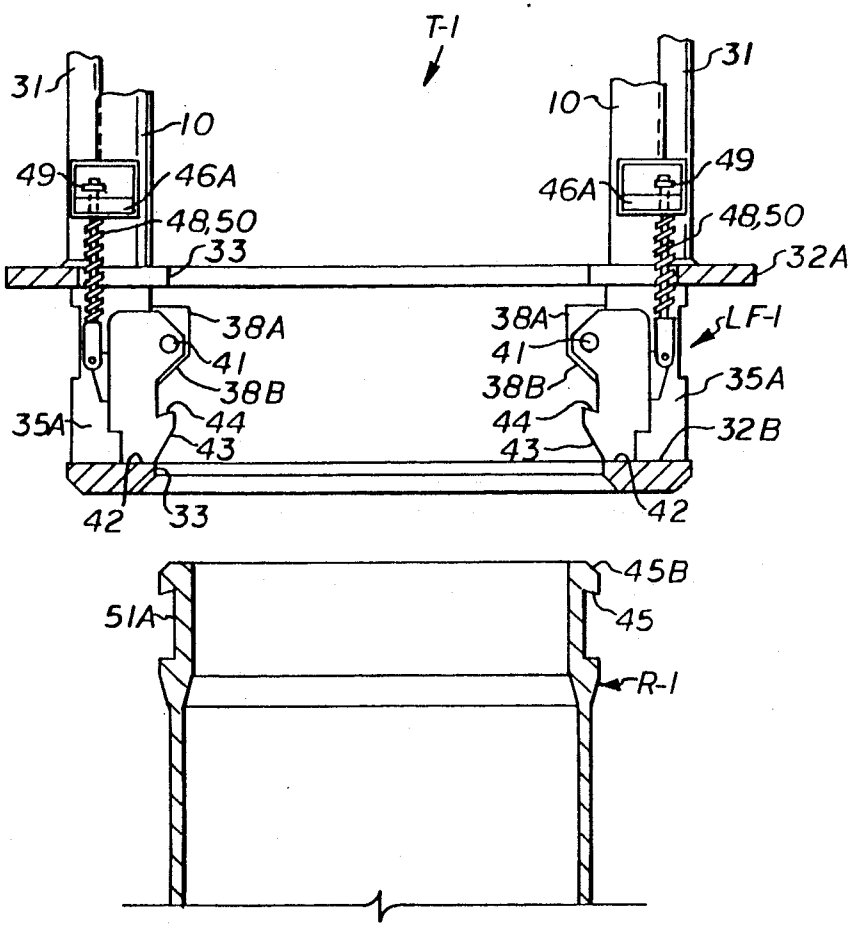
FIG. 20 is a cross section of a modification of the leveling apparatus having a latch frame and latch assembly adapted to engage a receptacle having an external load shoulder.

Referring now to FIGS. 20 and 21, there is shown a another embodiment of the leveling tool apparatus T-1 which has a modified latch frame assembly adapted to engage a receptacle having an external load shoulder. In the following description, the structures previously described are given the same numerals of reference.

In some circumstances, it may be desirable to lock or attach the leveling tool to the exterior of the receptacle of the structure to be leveled. In the leveling tool T-1, a receptacle R-1 is secured to the structure to be lifted. The receptacle R-1 is a cylindrical member having a circumferential groove 51A defining an exterior latching shoulder 45A formed at the upper end thereof. The top outer surface of the receptacle is angled to provide a support surface 45B.

The upper structure of the tool T-1 is identical to the tool T and the latch frame LF-1 is substantially similar to the previously described latch frame LF. The latch frame LF-1 has an upper plate 32A and a lower plate 32B with a central opening 33 therethrough. As shown and previously described with reference to FIG. 14, a plurality of circumferentially spaced tubular sleeves 34 are secured vertically between the upper and lower plates 32A and 32B in axial alignment with the tubular sleeves 26 of the cylinder frame CF. The lower ends of the stabilizer columns 10 extend downwardly from the guide sleeves 20 and are slidably received in the tubular sleeves 34, and the lower ends of the piston rods 31 extend downwardly from the cylinder frame CF and are bolted to the upper plate 32A in the manner previously described. Pairs of radially extending plates 35A are secured vertically between the upper and lower plates 32A and 32B between adjacent ones of the tubular sleeves and have inwardly extending ears 38A. The inner bottom surface of the ears 38A is angled 38B to conform to the angled support surface at the outer top end of the receptacle.

A generally J-shaped latch member 40 is received in the space between each pair of vertical plates 35A and is pivotally pinned at its upper outer end between each pair of ears 38A by a pivot pin 41. Each latch 40 is a flat member having flat bottom surface 42 and an inner side edge which extends angularly upward and inward from the bottom surface to serve as a camming surface 43 and has an outwardly and downwardly angled latch shoulder 44 which engages the corresponding angled load shoulder 45 on the exterior of the receptacle R-1. The flat bottom surface 42 of each latch 40 rests on the top surface of the lower plate 32B.

OPERATION

With reference to the embodiment of FIGS. 1–19, in the operation of the present invention, the leveling tool T is suspended from the support rigging C and lowered from the support vessel at the surface of the body of water until it is in position above the pile P (FIG. 6). As the leveling tool T is being lowered by the support rigging C, the latches 40 are held in the retracted position by the rods 48 and shelf ends 46A of the horizontal brackets 46 attached to the stabilizer columns 10. The lifting tool T is lowered until the stop plate 21 at the bottom of the landing ring LR contacts the upper end of the pile P (FIG. 7 and FIG. 13 with pile not shown for clarity).

The landing ring LR is now supported on the pile P, and the rigging C continues to lower the upper lift frame U allowing it to move vertically downward relative to the supported landing ring LR due to its weight (FIG. 7). When the upper lift frame U moves down, the columns 10 and subsequently the rod members 48 travel vertically downward with it relative to the latch frame LF which is held stationary by the cylinders 30 until the bottom of the columns 10 within the tubular sleeves 34 contact the top surface of the lower plate 32B of the latch frame LF. At this point the support rigging C goes slack. When the bottom of the columns 10 contact the lower plate 32B, a small gap is created between the top surface of the bracket shelf ends 46A and the heads 49 of the rods 48, allowing the latches 40 to pivot outwardly about the pivot pin 41 to assume the gravity controlled position. In the gravity controlled position, the angled camming surface 43 and latch shoulder 44 of the latches protrude outwardly of the latch frame LF, but are free to move inwardly. The weight of the leveling tool T is now supported by the pile P and the leveling tool is now in position on the pile P to be controlled from the support vessel.

Figure 9:
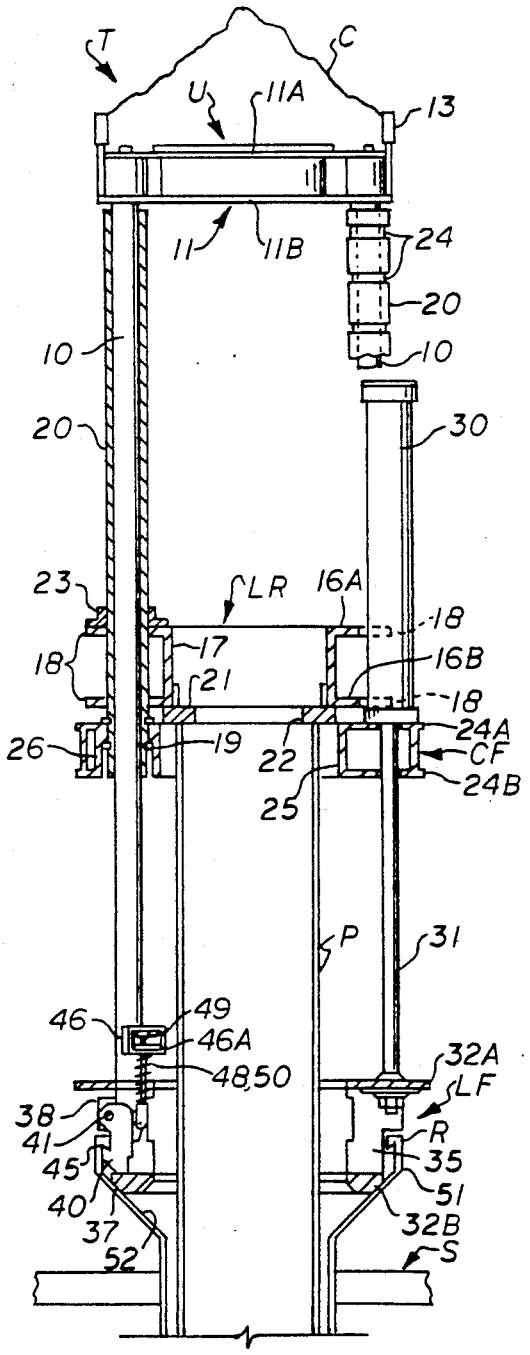
FIG. 9 is a longitudinal cross section of the leveling apparatus with the landing ring supported on the pile and the latch frame being pulled upward by the hydraulic cylinders to engage the latching shoulder of the latches in the receptacle.
Figure 17:
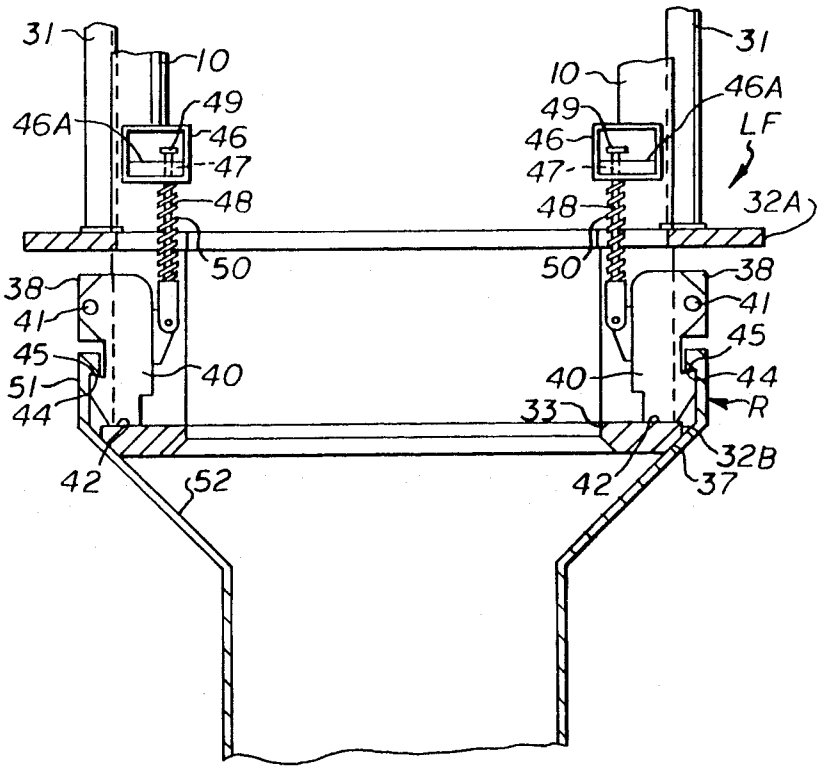
Figure 16:
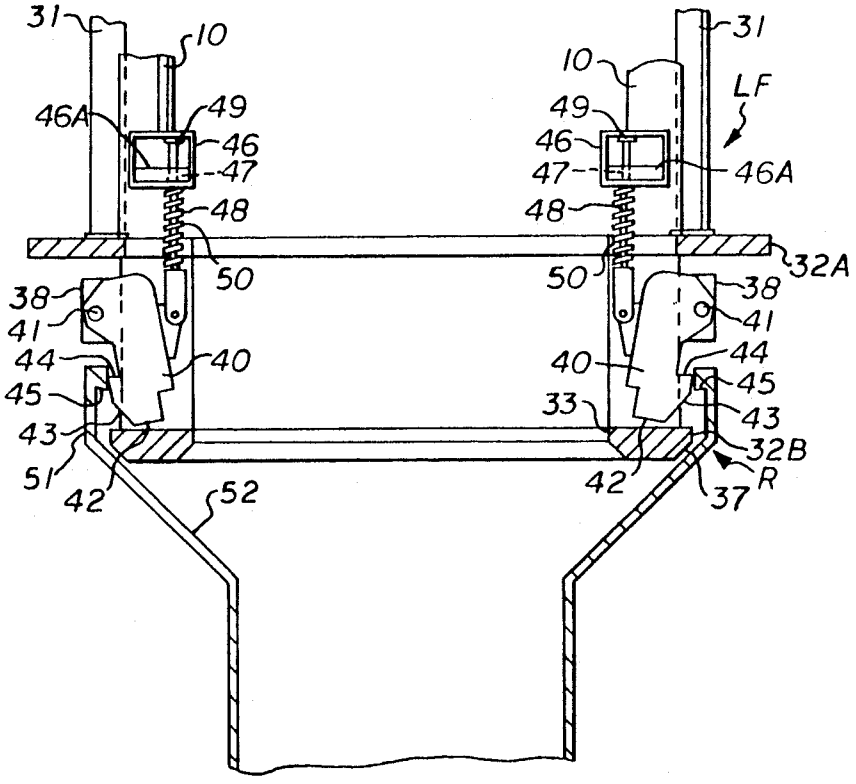
Figure 19:
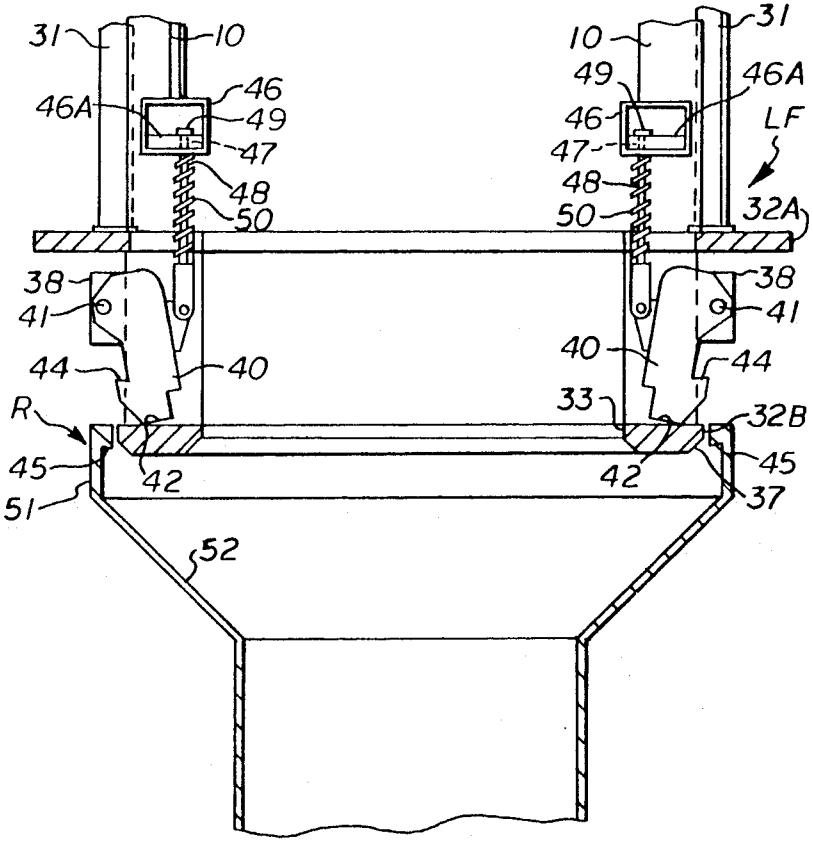

At this point, fluid pressure is applied from a source on the support vessel through the hydraulic lines to extend the cylinder rods 31, pushing the latch frame LF downwardly into the receptacle R. As the latch frame LF travels downwardly, the angled camming surfaces 43 of the latches 40 engage the top end of the receptacle R (FIG. 15) and pivot slightly inward as the latch shoulder 44 of the latches travels past the load shoulder 45 of the receptacle, and then pivot outwardly after passing the load shoulder 45 (FIGS. 16 and 17). This inward and outward movement is allowed due to the sliding connection of the rod members 48 in the horizontal bracket shelf ends 46A. Downward movement of the latch frame LF continues until the tapered surface 37 of the latch frame lower plate 32B contacts the mating tapered support surface 52 of the receptacle R (FIGS. 9 and 17).

After the latch frame LF has been landed in the receptacle R, hydraulic pressure is applied to the lift cylinders 30 to retract their rod ends 31 upwardly. This pulls the latch frame LF, stabilizer columns 10, and upper lift frame U upwardly (FIGS. 9 and 17). The upward movement firmly engages the latch shoulders 44 of the latches 40 with the load shoulder 45 in the receptacle R, thus positively locking the leveling tool T to the receptacle R.

Figure 10:
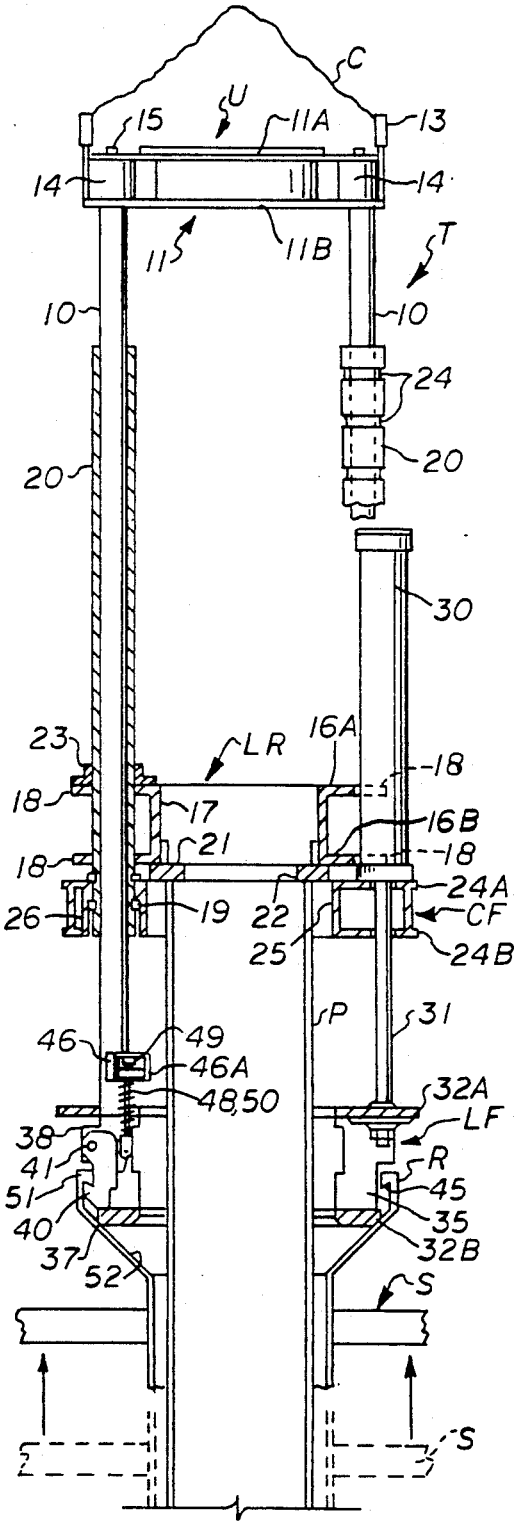
FIG. 10 is a longitudinal cross section of the leveling apparatus with the landing ring supported on the pile with the latching shoulder engaged in the receptacle and the receptacle with the connected structure being lifted relative to the pile by the hydraulic cylinders.

Since the landing ring LR is supported on the top of the pile P and the cylinder frame CF is connected to the landing ring LR by the guide sleeves 20, continued retraction of the cylinder rods 31 causes the receptacle R and the attached structure S to move vertically upward relative to the pile P until the upward motion of the cylinder rods 31 has ceased (FIG. 10). After the receptacle R and the attached structure S has been raised to the desired height, it can be held in the raised position while the structure is secured against subsequent vertical downward movement by grouting or swaging the pile P to the receptacle R, or installing slips or other suitable gripping mechanisms conventional in the art between the pile P and the structure.

Figure 11:
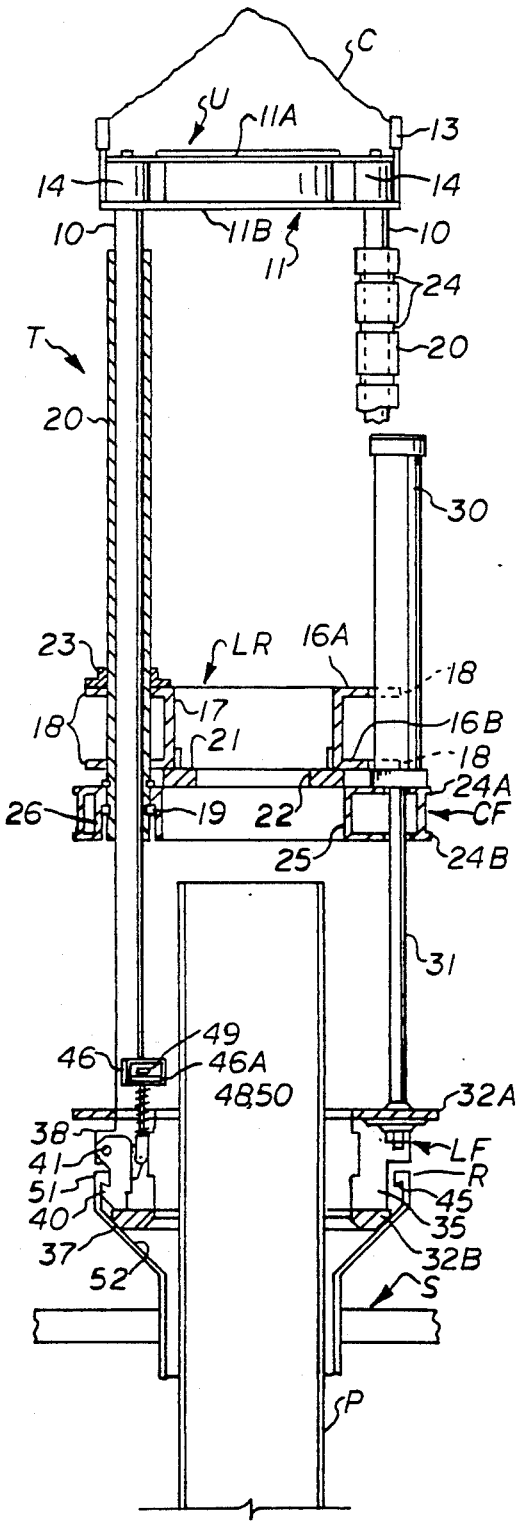
FIG. 11 is a longitudinal cross section of the leveling apparatus with the latch frame supported in the receptacle prior to the latches being retracted by the hydraulic cylinders.

After the structure S has been secured to the pile P, fluid pressure is again applied to extend the cylinder rods 31 to push the latch frame LF downward until the tapered lower surface 37 of the latch frame lower plate 32B again contacts the tapered support surface 52 of the receptacle R (FIGS. 11 and 17). Continued application of fluid pressure to the hydraulic cylinders 30 causes the cylinder rods 31 to push the cylinder frame CF and the landing ring LR (connected to the cylinder frame by guide sleeves 20) upwardly, thus disengaging the stop ring 21 from contact with the pile P. At this point of cylinder extension, the weight of the leveling tool is supported on the tapered support surface 52 of receptacle R.

Figure 18:
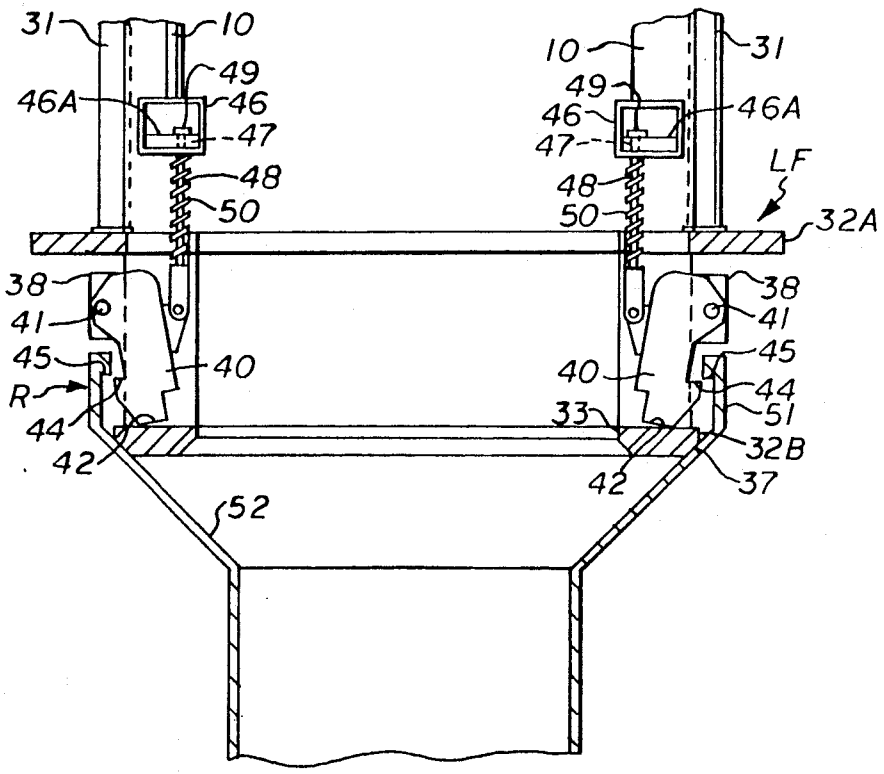

To positively disengage the latches 40 from the receptacle R, the cylinders 30 are fully extended. At the point of full cylinder extension, the guide sleeves 20 contact the lower plate 11B of the upper lift frame U which moves the support columns 10 upwardly causing the top surface of the shelf end 46A of the bracket 46 to contact the head 49 of the rod member 48 and pivot the latch 40 inwardly. (FIGS. 12 and 18). The leveling tool T can then be readily lifted upwardly out of contact with the tapered support surface 52 of receptacle R and moved to another portion of the structure S for further leveling operations or returned to the support vessel, as needed.

The leveling apparatus can also be removed by tugging upwardly on the support rigging after the tapered lower surface 37 of the latch frame lower plate 32A contacts the tapered support surface 52 of receptacle R which causes the support columns to move upwardly relative to the latch frame which in turn causes the latches 40 to pivot inwardly. Prior to stabbing into the next receptacle, the hydraulic cylinders 30 are fully retracted.

While this invention has been described fully and completely with special emphasis upon several preferred embodiments, it should be understood that within the scope of the appended claims the invention may be practiced otherwise than as specifically described herein.

We claim:

1. A leveling tool for leveling a subsea structure on a plurality of piles slidably received through receptacles secured to the structure and implanted in the floor of a body of water, comprising;

a tool receptacle secured to the structure to be leveled and having a load shoulder positioned a vertical distance relative to the top end of the pile which is received therethrough, a lift frame having a top end adapted for connection to support rigging from a support vessel and a plurality of elongate tubular members extending downwardly therefrom, a latch frame slidably mounted at the lower ends of said tubular members and having latch members pivotally mounted thereon and adapted to be releasably engaged with said receptacle load shoulder for locking to the structure to be leveled, a landing frame slidably mounted on said tubular members above said latch frame and adapted to be received and supported on the top end of the pile, a cylinder frame connected to said landing frame and having hydraulic cylinders secured thereon with their rod ends secured to said latch frame for extending and retracting said latch frame relative to said landing frame, and latch pivoting means operatively connected between said tubular members and said latch members for moving said latch members between an unlocked position when said lift frame is supported by the support rigging and a pivotally movable latching position when said landing frame is supported on said pile and between a locked position and an unlocked position upon relative movement between said latch frame and said tubular members.

2. A leveling tool according to claim 1 in which said lift frame, latch frame, landing frame, and cylinder frame are movable relative to one another such that in a tool lowering position, said latch frame is maintained in a fixed position relative to said landing frame by said hydraulic cylinders with said latch members held in an unlocked position by said latch pivoting means and said tool is lowered as a unit by the support rigging to engage said landing frame on the top end of the pile, and upon the landing frame being engaged and supported on the top of the pile, said lift frame and tubular members continuing to move downward relative to said landing frame and the relative movement therebetween causing said latch pivoting means to move said latches to the pivotally movable latching position, and thereafter tension on the support rigging is removed such that the tool is supported by the pile.

3. A leveling tool according to claim 2 wherein in a latch locking position, after said tool is supported by the pile, said hydraulic cylinders are extended to move said lift frame and said latch frame downwardly relative to said landing frame a distance to engage said latch members with said receptacle load shoulder and are then retracted to positively lock said latch members onto said receptacle load shoulder.

4. A leveling tool according to claim 3 wherein in a structure leveling position, after said latch members are positively locked onto said receptacle load shoulder, said hydraulic cylinders are further retracted to lift said receptacle and the structure to which it is secured relative to the pile such that the structure may be secured at a desired position onto the pile.

5. A leveling tool according to claim 4 wherein in a tool removing position, after the structure has been secured at a desired position on the pile, said hydraulic cylinders are extended to raise said cylinder frame, said landing frame, said lift frame and tubular members relative to said latch frame and the relative movement causes said latch pivoting means to move said latch members to the unlocked position to release them from said receptacle load shoulder and thereafter said tool being lifted as a unit from the pile and structure by the support rigging.

6. A leveling tool according to claim 4 wherein in a tool removing position, after the structure has been secured at a desired position on the pile, an upward pull is exerted on said lift frame to raise said lift frame and tubular members relative to said latch frame and the relative movement causes said latch pivoting means to move said latch members to the unlocked position to release them from said receptacle load shoulder and thereafter said tool being lifted as a unit from the pile and structure by the support rigging.

7. A leveling tool according to claim 1 in which said lift frame comprises a generally cylindrical upper portion having a central opening therethrough and lift means for connecting said lift frame to the support rigging, and said elongate tubular members are secured at their top ends to said lift frame in circumferentially spaced vertical relation.

8. A leveling tool according to claim 7 in which said lift frame has an upper plate and a lower plate with a plurality of circumferentially spaced tubular sleeves secured vertically between said upper and lower plates and the upper ends of said elongate tubular members are received and secured in said tubular sleeves.

9. A leveling tool according to claim 1 in which said cylinder frame comprises a generally cylindrical frame having a central opening therethrough, and said hydraulic cylinders comprise a plurality of hydraulic cylinders mounted on said cylinder frame with their bodies extending vertically upwardly in circumferentially spaced relation with their rod ends extensible downwardly from said cylinder frame.

10. A leveling tool according to claim 9 including a plurality of elongate tubular guide sleeves secured to said cylinder frame and extending vertically upwardly therefrom in circumferentially spaced relation, and said lift frame elongate tubular members extend slidably through said elongate tubular guide sleeves to allow relative vertical movement between said cylinder frame and said lift frame.

11. A leveling tool according to claim 10 in which said plurality of elongate tubular guide sleeves extend vertically upwardly circumferentially spaced relation between adjacent ones of said hydraulic cylinders.

12. A leveling tool according to claim 9 in which said landing frame has a circular load bearing member at its bottom end with a central opening smaller in diameter than the pile on which it is to be supported, and a plurality of circumferentially spaced vertical apertures extending therethrough to slidably receive said elongate tubular guide sleeves.

13. A leveling tool according to claim 12 including adjustable clamp means on said landing frame to be selectively engaged with said elongate tubular guide sleeves extending therethrough, whereby said landing frame is adjustably connected to said elongate tubular guide sleeves to facilitate vertical spacing of said landing frame load bearing member relative to said latch frame and the top end of the pile on which it is to be supported.

14. A leveling tool according to claim 1 in which said latch frame is a generally cylindrical configuration having an upper plate and a lower plate with a central opening therethrough and a plurality of circumferentially spaced vertical apertures through the top plate to receive the lower ends of said lift frame elongate tubular members and the bottom plate serving as a stop surface for the bottom ends of said elongate tubular members, a plurality of latch mounting plate members secured vertically between said top and bottom plates in circumferentially spaced relation, and said latch members are pivotally mounted on said latch mounting plates adjacent the lower ends of said elongate tubular members.

15. A leveling tool according to claim 14 in which each said latch member comprises a rectangular generally J-shaped latch member pivotally connected at its upper end to a said latch mounting plate and having a flat bottom surface, an outer side edge which extends angularly upward and outward from said flat bottom surface to serve as a camming surface, an inwardly angled latch shoulder configured to releasably engage and lock with a correspondingly angled load shoulder on said receptacle.

16. A leveling tool according to claim 15 in which said latch frame upper plate has a plurality of apertures above each said latch member, and said latch pivoting means comprises a pair of bracket members connected to the lower end of each said elongate tubular member above said latch frame top plate which extend laterally outward to each side thereof and each having a flat outer end positioned above each said top plate aperture and said latch member with apertures therethrough in axial alignment with said top plate apertures, and a latch rod extending slidably through said bracket apertures and said top plate apertures and having a head at one end disposed above said bracket flat end and its lower end pivotally connected to one side of said latch member, whereby in a tool lowering position, said elongate tubular members and said latch frame are maintained a vertically spaced distance apart by said hydraulic cylinders such that said latch rod head is engaged on said bracket flat end and said latch is maintained in a retracted condition by the upward force on said latch rod, and upon said landing frame being engaged and supported on the top of the pile, said lift frame elongate tubular members move downward relative to said landing frame and said latch frame and upon sufficient relative vertical movement between said latch frame and said elongate tubular members toward one another, said latches assume a pivotally movable latching position in which said latch rod head is free to travel up and down relative to said bracket flat end and said latches are free to pivot about their pivotal mounting as said latch camming surface moves inwardly and outwardly as they travel past said receptacle load shoulder, and in a latch locking position, after said landing frame is supported on the pile and said hydraulic cylinders are retracted, said latch frame is moved vertically upward relative to said elongate tubular members to engage said landing frame bottom plate on said latch flat bottom surface to prevent pivotal movement, and in a tool removing position, said hydraulic cylinders are extended to raise said cylinder frame, said landing frame and said lift frame elongate tubular members relative to said latch frame, the relative vertical movement between elongate tubular members and said latch frame away from one another will engage said bracket flat end with said latch rod head pulling upward on said latch rod to pivot said latch about its pivotal mounting and retract it from engagement with said receptacle load shoulder, and thereafter said tool may be lifted as a unit from the pile and structure by the support rigging.

17. A leveling tool according to claim 16 including a compression spring received on the shank of said latch rod and having one end engaged on the underside of said bracket flat end and its other end engaged on the lower end of said latch rod to normally urge the latch rod downwardly, whereby said latches are spring biased in the pivotally movable latching position and said latch rod head is resiliently urged into engagement with said bracket flat end but free to travel up and down under spring tension when said latches pivot about their pivotal mounting as said latch camming surfaces move inwardly and outwardly as they travel past said receptacle load shoulder.

18. A leveling tool according to claim 15 in which said tool receptacle comprises a pipe sleeve having a cylindrical load shoulder at its top end and an inwardly and downwardly tapered conical latch frame support portion therebelow, the outer surface of said latch frame bottom plate is configured to generally correspond with said conical latch frame support portion for supporting the weight of said tool thereon, and said latch members are pivoted outwardly and upwardly into engagement with and lock with said receptacle load shoulder.

19. A leveling tool according to claim 15 in which said tool receptacle comprises a cylindrical member having a circumferential groove defining an exterior latching shoulder formed at the upper end thereof and the top outer surface of the cylindrical member is angled to provide a support surface, and said latch mounting plates have a surface configured to generally correspond to the angled support surface at the outer top end of said cylindrical member to be received thereon for supporting the weight of said tool, and said latch members are pivoted inwardly and upwardly into engagement with and lock with said receptacle latching shoulder.

20. A method of leveling a subsea structure on one or more piles comprising the steps of;

securing cylindrical receptacles on the structure to be leveled, driving a pile through each receptacle, and implanting it in the floor of a body of water with its top end spaced a vertical distance relative to the receptacle, each said receptacle having a load shoulder, providing a leveling tool and connecting it to support rigging from a support vessel, said leveling tool having a lift frame and a plurality of elongate tubular members extending downwardly therefrom, a latch frame slidably mounted at the lower ends of said tubular members and having latch members pivotally mounted thereon and adapted to be releasably engaged with said receptacle load shoulder for locking to the structure to be leveled, a landing frame slidably mounted on said tubular members above said latch means and adapted to be received and supported on the top end of the pile, a cylinder frame connected to said landing frame and having hydraulic cylinders secured thereon with their rod ends secured to said latch frame for extending and retracting said latch frame relative to said landing frame, and latch pivoting means operatively connected between said tubular members and said latch members for moving said latch members between an unlocked position when said lift frame is supported by the support rigging and a pivotally movable latching position when said landing frame is supported on said pile and between a locked position and an unlocked position upon relative movement between said latch frame and said tubular members, actuating said hydraulic cylinders to maintain said latch frame in a fixed position relative to said landing flange with said latch members held in an unlocked position by said latch pivoting means and lowering said tool as a unit by the support rigging to engage said landing frame on the top end of the pile, upon said landing frame being engaged and supported on the top of the pile, allowing the weight of said lift frame and tubular members to continue downward movement relative to said landing frame and the relative movement therebetween causing said latch pivoting means to move said latches to the pivotally movable latching position, and thereafter removing tension in the support rigging such that the tool is supported by the pile, extending said hydraulic cylinders to move said lift frame and said latch frame downwardly relative to said landing frame a distance to engage said latch members with said receptacle load shoulder and then retracting said cylinders to positively lock said latch members onto said receptacle load shoulder, further retracting said hydraulic cylinders to lift said receptacle and the structure to which it is secured to a desired position relative to the pile, securing the structure to the pile at the desired position, and thereafter removing said tool from said receptacle, and repeating the above recited steps at other receptacle locations as necessary until the structure is at the desired level.

21. A method of leveling a subsea structure according to claim 20 wherein the step of removing said tool comprising the steps of;

extending said hydraulic cylinders to raise said cylinder frame, said landing frame, said lift frame and tubular members relative to said latch frame such that the relative movement causes said latch pivoting means to move said latch members to the unlocked position to release them from said receptacle load shoulder, and thereafter lifting said tool as a unit from the pile and structure by the support rigging.

22. A method of leveling a subsea structure according to claim 20 wherein the step of removing said tool comprising the steps of;

pulling upward on said lift frame with the support rigging to raise said lift frame and tubular members relative to said latch frame such that the relative movement causes said latch pivoting means to move said latch members to the unlocked position to release them from said receptacle load shoulder, and thereafter lifting said tool as a unit from the pile and structure by the support rigging.

* * * * *